US011466682B2

(12) United States Patent
Christian-Tabak et al.

(10) Patent No.: US 11,466,682 B2
(45) Date of Patent: Oct. 11, 2022

(54) TWIN DISC PUMP

(71) Applicant: Komline-Sanderson Corporation, Peapack, NJ (US)

(72) Inventors: Leo Christian-Tabak, Hartsdale, NY (US); John William Dieckmann, Butler, NJ (US); Nicholas Charles Degrose, Milford, NJ (US)

(73) Assignee: KOMLINE-SANDERSON CORPORATION, Peapack, NJ (US)

( * ) Notice: Subject to any disclaimer, the term of this patent is extended or adjusted under 35 U.S.C. 154(b) by 278 days.

(21) Appl. No.: 16/581,897

(22) Filed: Sep. 25, 2019

(65) Prior Publication Data

US 2020/0095990 A1 Mar. 26, 2020

Related U.S. Application Data

(60) Provisional application No. 62/736,032, filed on Sep. 25, 2018.

(51) Int. Cl.

| | |
|---|---|
| ***F04B 53/16*** | (2006.01) |
| ***F04B 43/00*** | (2006.01) |
| ***F04B 53/22*** | (2006.01) |

(52) U.S. Cl.

CPC ..... *F04B 53/16* (2013.01); *F04B 43/0045* (2013.01); *F04B 53/22* (2013.01)

(58) Field of Classification Search

CPC .... F04B 1/02; F04B 9/02; F04B 15/02; F04B 43/0045; F04B 43/026; F04B 53/16; F04B 53/22; B25B 11/00; B23Q 3/00; B23Q 3/08; F01B 19/02; F16J 15/02; F16J 15/06; F16J 15/08

USPC ..... 417/224, 254, 265; 92/128; 248/637, 248/671, 672, 678, 676; 29/281.1; 269/73; 277/630, 637, 641, 642, 644, 277/650

See application file for complete search history.

(56) References Cited

U.S. PATENT DOCUMENTS

| | | | | |
|---|---|---|---|---|
| 3,164,100 A | | 1/1965 | Hughes | |
| 3,489,016 A | * | 1/1970 | Quinby | G01C 19/16 74/5.22 |
| 3,736,639 A | * | 6/1973 | Letters | F16C 7/023 29/888.091 |
| 3,759,146 A | * | 9/1973 | Brotherton | F16J 10/02 92/255 |

(Continued)

*Primary Examiner* — Devon C Kramer
*Assistant Examiner* — Joseph S. Herrmann
(74) *Attorney, Agent, or Firm* — Buckley, Maschoff & Talwalkar LLC

(57) ABSTRACT

Provided is a twin disc pump which includes split rod bearings for connecting pump discs to a drive shaft, and pedestal bearings that also receive the drive shaft. The split rod bearings can be disassembled without having to disassemble any portion of a housing of the pump. Accordingly, an operator can gain access to the split rod bearings, the pedestal bearings, and the drive shaft from above the pump without having to access the pump from below. The twin disc pump also includes a new attachment mechanism for connecting a top portion of the housing to an intermediate portion. The twin disc pump also includes a modified metal ring for improved leakage prevention and easier release. The twin disc pump may also be included within a system including a frame capable of locking the pump in different orientations.

15 Claims, 15 Drawing Sheets

(56) References Cited

U.S. PATENT DOCUMENTS

| | | | | | |
|---|---|---|---|---|---|
| 4,473,339 | A | | 9/1984 | Hughes | |
| 4,475,777 | A | * | 10/1984 | Hofmann | F16C 23/086 384/572 |
| 5,174,731 | A | | 12/1992 | Korver | |
| 5,334,001 | A | * | 8/1994 | Williams | F04B 15/02 417/360 |
| 6,183,211 | B1 | * | 2/2001 | Wood | F04B 25/005 417/246 |
| 6,315,532 | B1 | * | 11/2001 | Appleby | F04B 11/0075 417/510 |
| 7,559,753 | B2 | * | 7/2009 | Burrage | F04B 43/0018 417/539 |
| 2012/0211470 | A1 | * | 8/2012 | Webster | F16C 33/48 219/69.17 |

* cited by examiner

RUN POSITION

600

TWIN DISC PUMP

CROSS-REFERENCE TO RELATED APPLICATIONS

This application claims the benefit of US Provisional Application No. 62/736,032 filed on Sep. 25, 2018, in the United States Patent and Trademark Office, the entire disclosure of which is hereby incorporated herein for all purposes.

BACKGROUND

A twin disc pump combines the features of a positive displacement pump and the principle of induced flow to provide superior versatility in fluids handling. Based on a free-disc technology, a twin disc pump operates so that the discs perform the duties of both diaphragm and valve, providing a double acting, non clogging, pumping action. The two discs include a suction disc disposed near an inlet of fluid chamber and a discharge disc disposed closer to an outlet of the fluid chamber. Through an arrangement of connecting rods and a drive shaft, a reciprocating action of the discs is created causing fluid to pump from the inlet to the outlet of the cavity in a continuous flow.

The large valve-like discs mean that solids, rags and fibrous materials can be handled without loss of pumping action. The valve-like discs have large seating areas that provide for low internal velocities, extending the pump wear life on abrasive sludges and slurries. The fluid chamber may be sealed (e.g., with flexible trunnions, etc.) which eliminates packings, mechanical seals, and requires no flushing water or other forms of lubrication. The large diameter discs are proven to handle large solids, rags, plastics, etc., that would cause other pumps to fail.

However, over time, both of the pump discs (rubber) wear down over time. Likewise, the bearings that connect the rods to the drive shaft also tend to wear down over time. In order to replace or repair the pump discs, an operator must remove a bottom segment of the pump housing. Likewise, the operator must further remove the housing of the pump to gain access to the drive shaft which is disposed above the housing. Therefore, to replace or repair the bearings (or the shaft), an operator must remove the bottom of the pump and work from underneath the pump. This can be an unwelcome task given that the pump is typically disposed in sludge.

BRIEF DESCRIPTION OF THE DRAWINGS

Features and advantages of the example embodiments, and the manner in which the same are accomplished, will become more readily apparent with reference to the following detailed description taken in conjunction with the accompanying drawings.

Figure 1A:
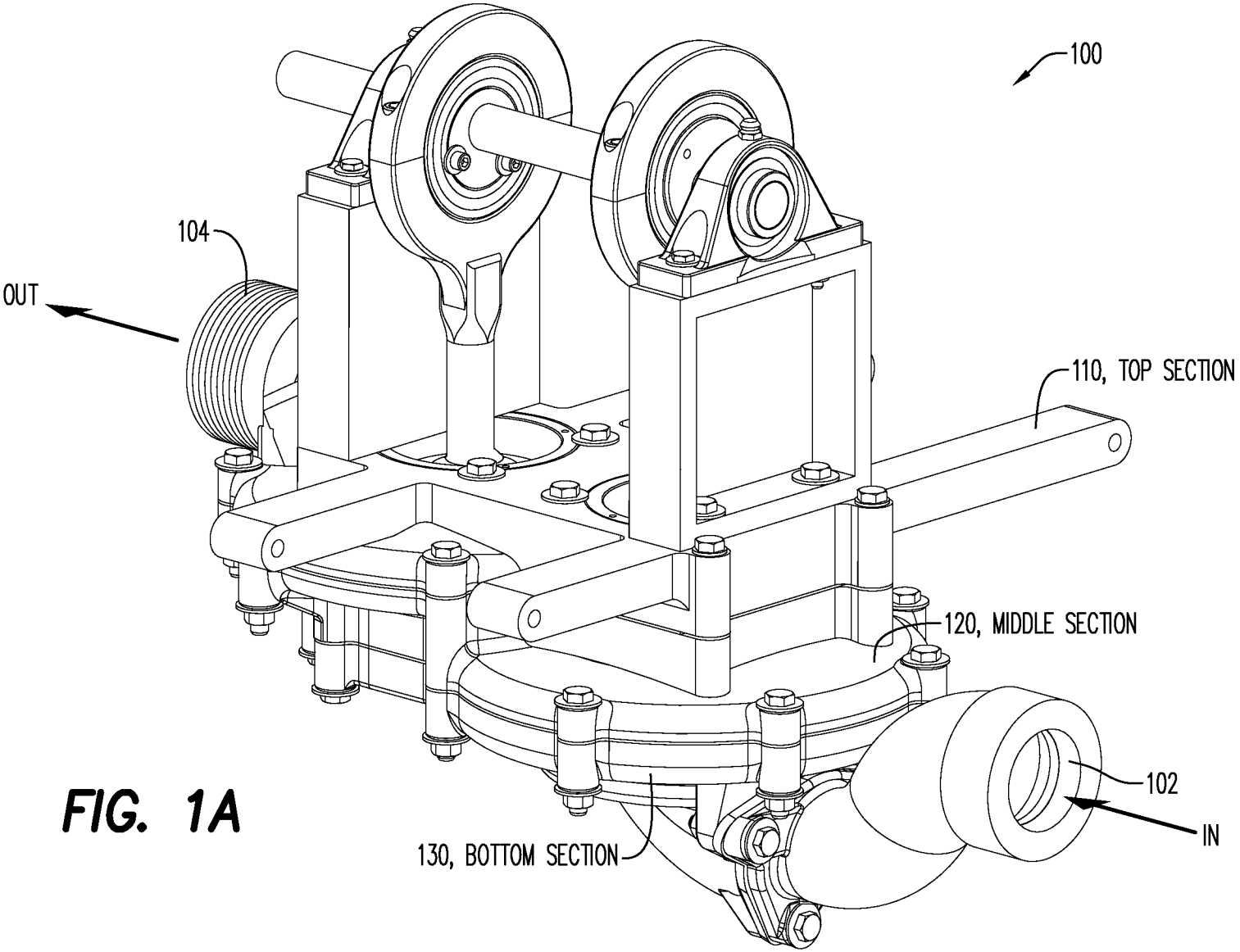
FIGS. 1A-1B are diagrams illustrating an overview of a twin disc pump in accordance with an example embodiment.

Throughout the drawings and the detailed description, unless otherwise described, the same drawing reference numerals will be understood to refer to the same elements, features, and structures. The relative size and depiction of these elements may be exaggerated or adjusted for clarity, illustration, and/or convenience.

DETAILED DESCRIPTION

In the following description, details are set forth to provide a thorough understanding of various example embodiments. It should be appreciated that modifications to the embodiments will be readily apparent to those skilled in the art, and generic principles defined herein may be applied to other embodiments and applications without departing from the spirit and scope of the disclosure. Moreover, in the following description, numerous details are set forth as an explanation. However, one of ordinary skill in the art should understand that embodiments may be practiced without the use of these specific details. In other instances, well-known structures and processes are not shown or described so as not to obscure the description with unnecessary detail. Thus, the present disclosure is not intended to be limited to the embodiments shown, but is to be accorded the widest scope consistent with the principles and features herein.

According to various embodiments, a twin disc pump (also referred to as a dual disc pump) includes split rod bearings for connecting pump discs to an unbalanced and rotating drive shaft, and pillow block bearings that also receive the unbalanced drive shaft. Each split rod bearing includes a top portion and a bottom portion which can be detachable with respect to each other. In some embodiments, the pillow block bearings may also be split. In the example embodiments, a user can remove (e.g., unscrew) the top portion of the rod bearings from the bottom portions and remove the drive shaft from above. Therefore, according to the novel configuration provided herein, the drive shaft and the bearings can be disassembled and repaired or replaced without having to disassemble any portion of a housing of the pump. Accordingly, an operator can gain access to the split rod bearings and the drive shaft from above the pump without having to access the pump from below.

Other new features and advantages of the dual disc pump include a new attachment mechanism for connecting a top portion of the housing to an intermediate portion without the use of a pedestal. The twin disc pump also includes a modified metal ring for improved leakage prevention and easier release. The dual disc pump may also be included within a pump system including a frame capable of locking the pump in different orientations. In the pump system, a user can swing/flip the dual disc pump 180° thereby enabling access to the underneath portion of the pump without the user having to get down and work from below. In some cases, the pump system can be actuated or automated through the use of a hydraulic lift, etc.

Figure 1B:
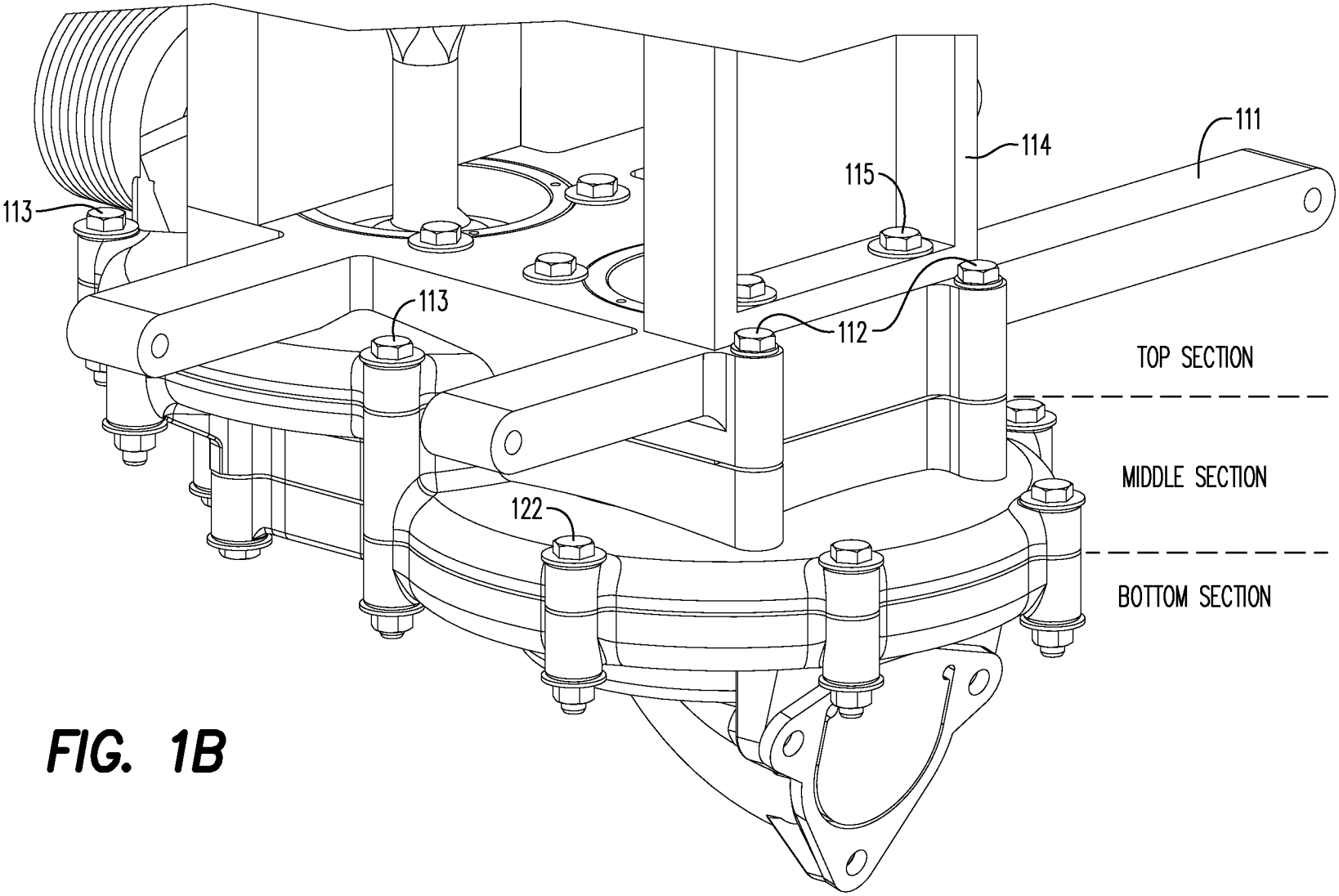

FIGS. 1A-1B illustrate an overview of a twin disc pump 100 in accordance with an example embodiment. Referring to FIG. 1A, the twin disc pump 100 may be used to pump sludge or other fluid from an inlet end 102 to an outlet end 104. Other types of uses/fluids that can be pumped include industrial waste, raw sewage, poultry wastes, and other harsh materials. Regardless of how the pump is used, the flying discs alternate up and down causing fluid to move through the pump in combination with the check valve (little flap in the pump that blocks and releases fluid from leaving the pump 100. Inside the pump are two rubber pump discs, and above the rubber discs are upper discs that stretch up and down which prevent the need for a sliding seal.

Referring to FIGS. 1A and 1B, the pump includes a top section 110 which may be referred to a drive shaft section, a middle section 120 which may be referred to an intermediate housing, and a bottom section 130 which may be referred to as a bottom of the housing.

Referring to FIG. 1B, each of the top section 110, the middle section 120, and the bottom section 130 can be detached from the others, if necessary. The top section 110 and the middle section 120 may be fastened or otherwise secured to each other using various securing means such as screws/bolts 112 and 113 shown in FIG. 1B. In contrary to traditional twin disc pumps, in this example a substrate 111 of the top section 110 and a housing of the middle section 120 are fastened using screws bolts 112 which are disposed on the exterior of a pedestal 114 of the top section 110, and which are independent from a securing means 115 used to secure the pedestal 114 to the substrate 111. Also securing means 122 may be used to secure the middle section 120 to the bottom section 130. Each of the securing means may be unscrewed or otherwise removed by a hand of a user.

Figure 2A:
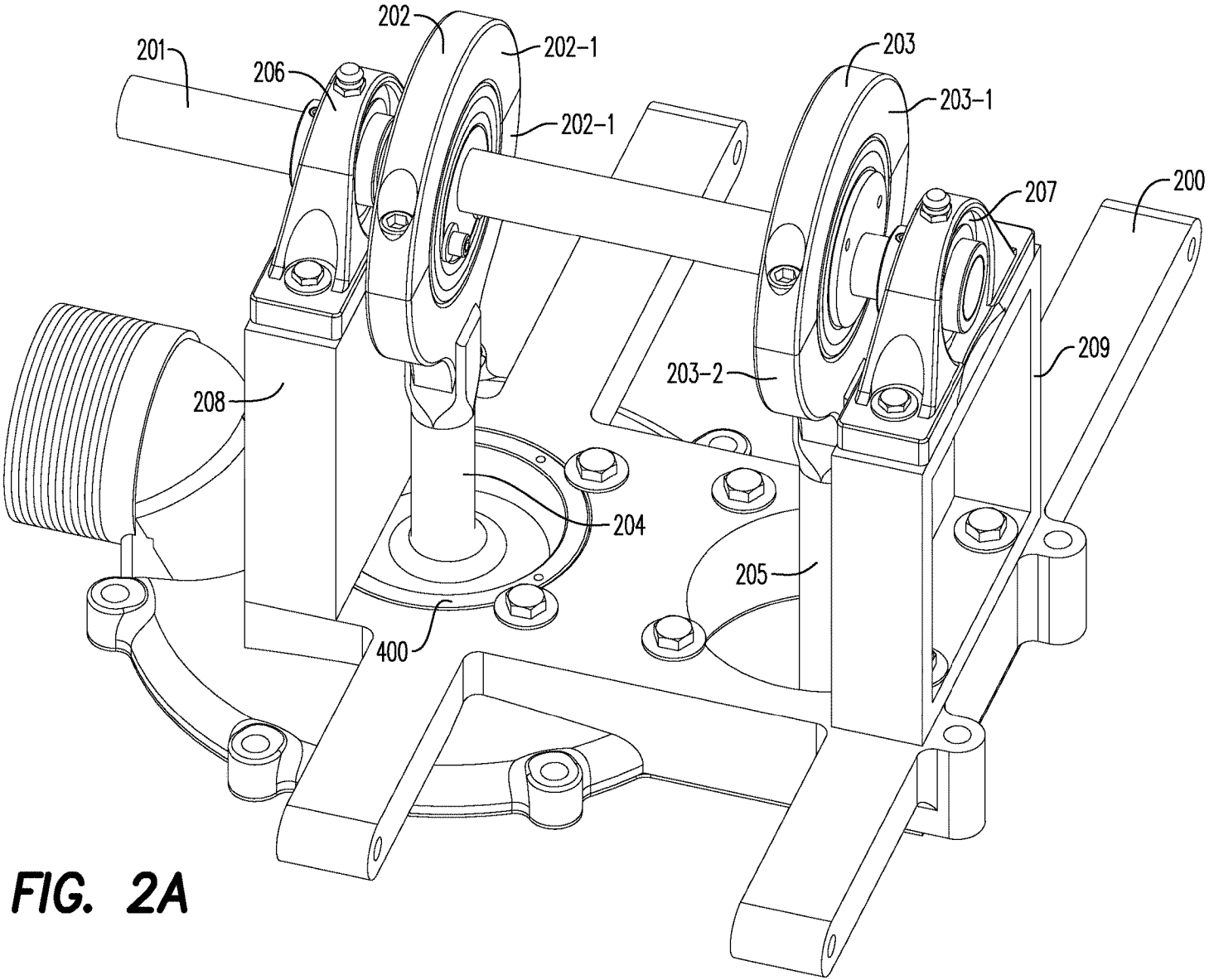
FIGS. 2A-2C are diagrams illustrating various states of a shaft portion of the twin disc pump in accordance with example embodiments.
Figure 2B:
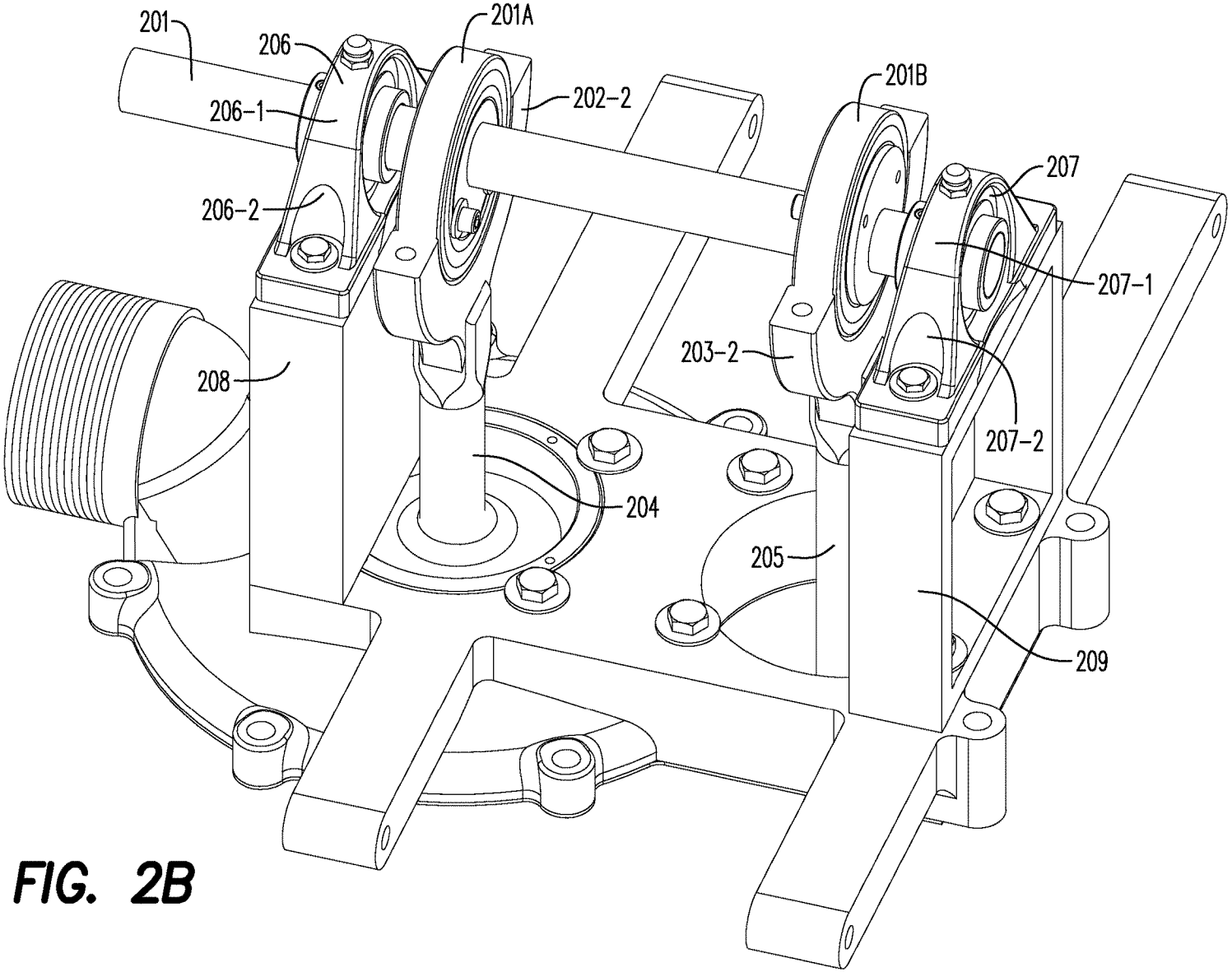
Figure 2C:
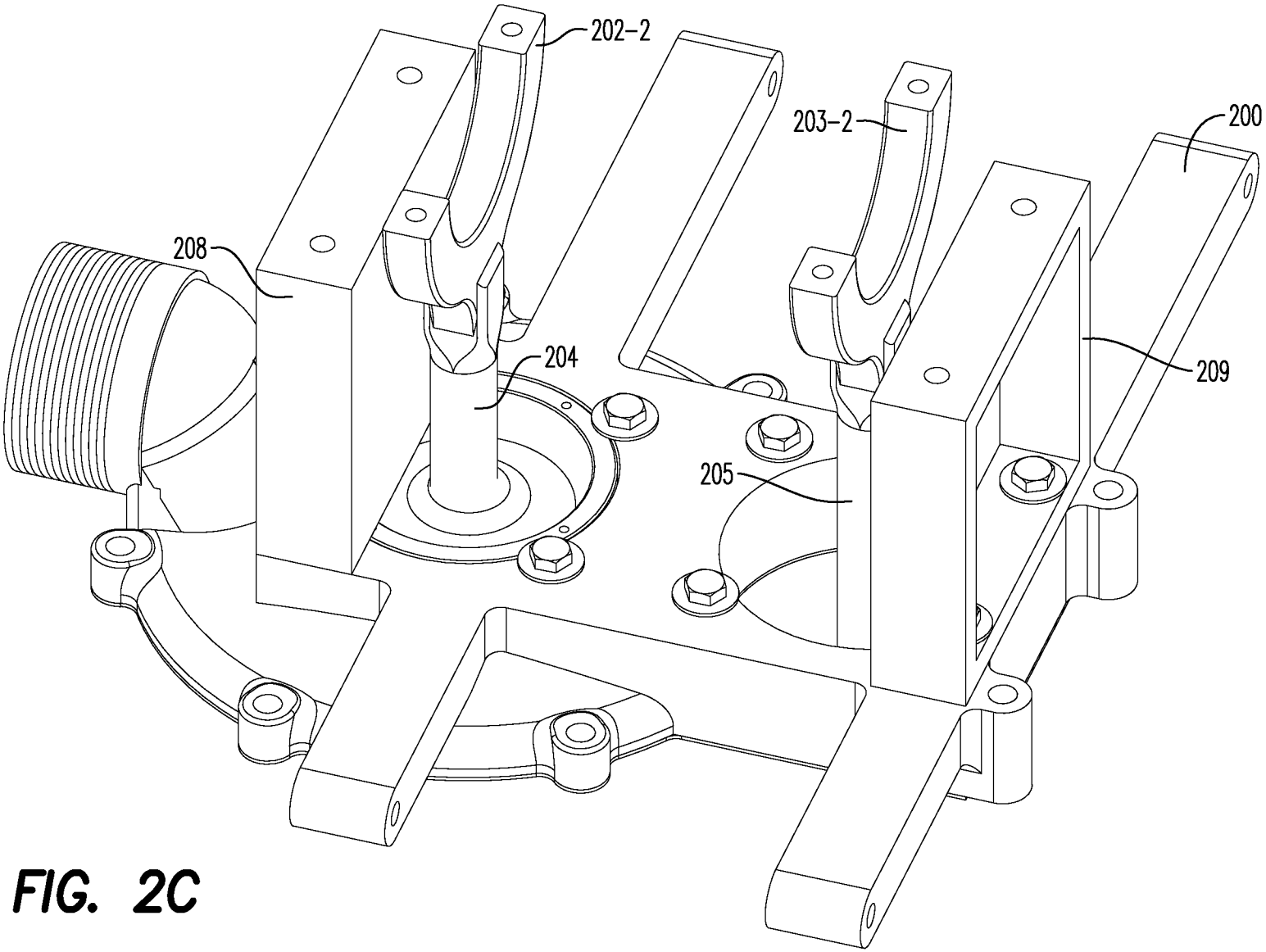

FIGS. 2A-2C illustrate various states of a shaft portion 201 of the twin disc pump in accordance with example embodiments. Traditional twin disc pumps use a vertical pedestal with a flange bearing on it to hold/receive the drive shaft and also connect the drive shaft to the pump discs. In contrast, the twin disc pump described herein changes the way a drive shaft 201 attaches to pump discs (e.g., 312 and 314 shown in FIG. 3). In the traditional design, a vertical pedestal includes a flange bearing on it which attaches a rod to the pump discs. Therefore, for an operator to remove the drive shaft, the operator must unbolt the pedestal at its base and back out the screws on its bearing and slide the whole assembly off the shaft which is difficult when the pump is connected to its motor.

In contrast, according to the novel assembly provided herein and as shown in FIGS. 2A-2C, the pump discs are connected to the drive shaft 201 using a split rod bearings 202 and 203 which each include a top portion 202-1 and 203-1 which are detachably secured to a bottom portion 202-2 and 203-2, respectively, which are detachable from each other using a securing means such as a screw. In this example, split rod bearing 202 may be referred to as a discharge rod bearing and split rod bearing 203 may be referred to as suction rod bearing. Here, each split rod bearing (or rod end) includes a top and bottom portion that can be removably attached. In other words, the rod-end is now a two-piece construction (e.g., 202-1 and 202-2, etc.) so it can be removed from the drive shaft 201 without having to remove a pedestal assembly including pedestals 208 and 209 and pedestal bearings 206 and 207.

The split rod bearings 202 and 203 are each connected to respective rods 204 and 205 which attach to respective pump discs (not shown) within the intermediate section of the pump. The drive shaft 201 may include an unbalanced shaft. In this case, when the drive shaft 201 is rotated (e.g., by a motor) the drive shaft 201 can cause one pump disc to move upward while the other pump disc moves downward based on the unbalanced alignment of the drive shaft 201. In this way, the drive shaft 201 causes the pump discs to create reciprocating movement within a fluid chamber in the intermediate housing of the pump thereby inducing flow of the fluid therein.

In these examples, the pedestal bearings 206 and 207 are pillow-block bearings which are independent of the pedestals 208 and 209, respectively. As shown in FIG. 2B, each pedestal bearing includes a top section 206-1 and 207-1 which is detachably connected to a bottom section 206-2 and 207-2, respectively. Furthermore, screws in a base of the pedestals 208 and 209 are not needed or required to connect the top section of the pump to the intermediate section of the pump as is done in the traditional twin disc pump. Instead, the top section of the pump is attached to the middle section with two extra screws on the far right side of the top section as shown by reference number 112 in FIG. 1B.

As a result of the split rod ends 202 and 203, the pedestal bearings 206 and 207, and the additional securing means 112, the drive shaft 201 can come right up off the pump without having to disassemble the entire pump from below. The two pedestals 208 and 209 and the pedestal bearings 206 and 207 bearings on top of the pedestals 208 and 209 are used to separately hold the drive shaft 201 independent of the split rod bearings 202 and 203. Meanwhile, rods 204 and 205 are connected to pump discs and are disposed on the inner side of the pedestals 208 and 209. The rods 204 and 205 connect to the drive shaft 201 via the split rod bearings 202 and 203, respectively. As a result, the rods 204 and 205 holding the dual discs are decoupled from the pedestals 208 and 209 which support the drive shaft 201. This decoupled design enables the pump discs to be connected to the drive shaft 201 independently of the pedestals 208 and 209. Furthermore, the extra securing means 112 allows the top section to be secured to the middle section while any of the drive shaft 201, the split rod bearings 202 and 203 are detached or otherwise decoupled.

FIG. 2C shows an example where the top sections 202-1 and 203-1 of the split rod bearings have been removed, the top sections 206-1 and 207-1 of the pedestal bearings have been removed, and the drive shaft 201 has been removed. In this case, the rest of the pump can remain assembled.

The drive shaft has vibration because of the unbalanced positioning of the drive shaft through the two sides of the pedestal bearings, and the rod ends. As a result of the split bearing design (rod ends and pedestal bearings), you can now lift the drive shaft right off the pump without having to disassemble the pump from underneath (which is required by traditional designs). Instead, a user can simply disassemble the rod ends and the pedestal bearings from the top, and the shaft comes right out. The reason for the disassembling is that there are ball bearings inside the rod ends that need to be replaced over time. In order to replace the ball bearings in the traditional design, the drive shaft has to be removed and taken out of the way to enable an operator to access the ball bearings. Furthermore, because the rod ends are one uniform design, the operator may need to press the ball bearings out which can require special machining (press) or a user pressing on it with a screw driver. The only way to replace them in the traditional design is to disassemble the whole pump.

According to various aspects, this invention uses split rod ends (or rod bearings) which are interior of the pedestals and the detachable pedestal bearings separating the connection to the pump from the connection to the middle section. In other words, rather than the pedestals performing the function of both connecting to the intermediate housing section and the rods/pumps, the invention bifurcates the pedestals and the rods creating separate connections to the drive shaft.

This enables the operator to easily remove the top section of the dual disc pump without having to go up through the bottom of the dual disc pump. Furthermore, the operator can easily pop out the ball bearing from split rod end without a need for tooling or special machining. This can be of significant benefit during operation because the dual disc pump is usually covered with sludge and accessed via the bottom which can be an unpleasant task. This also ties into the use of the two extra screws on the middle section which allow for the bottom section of the dual pump to be removed from the middle section without affecting the pedestal bearings holding the drive shaft.

Figure 3A:
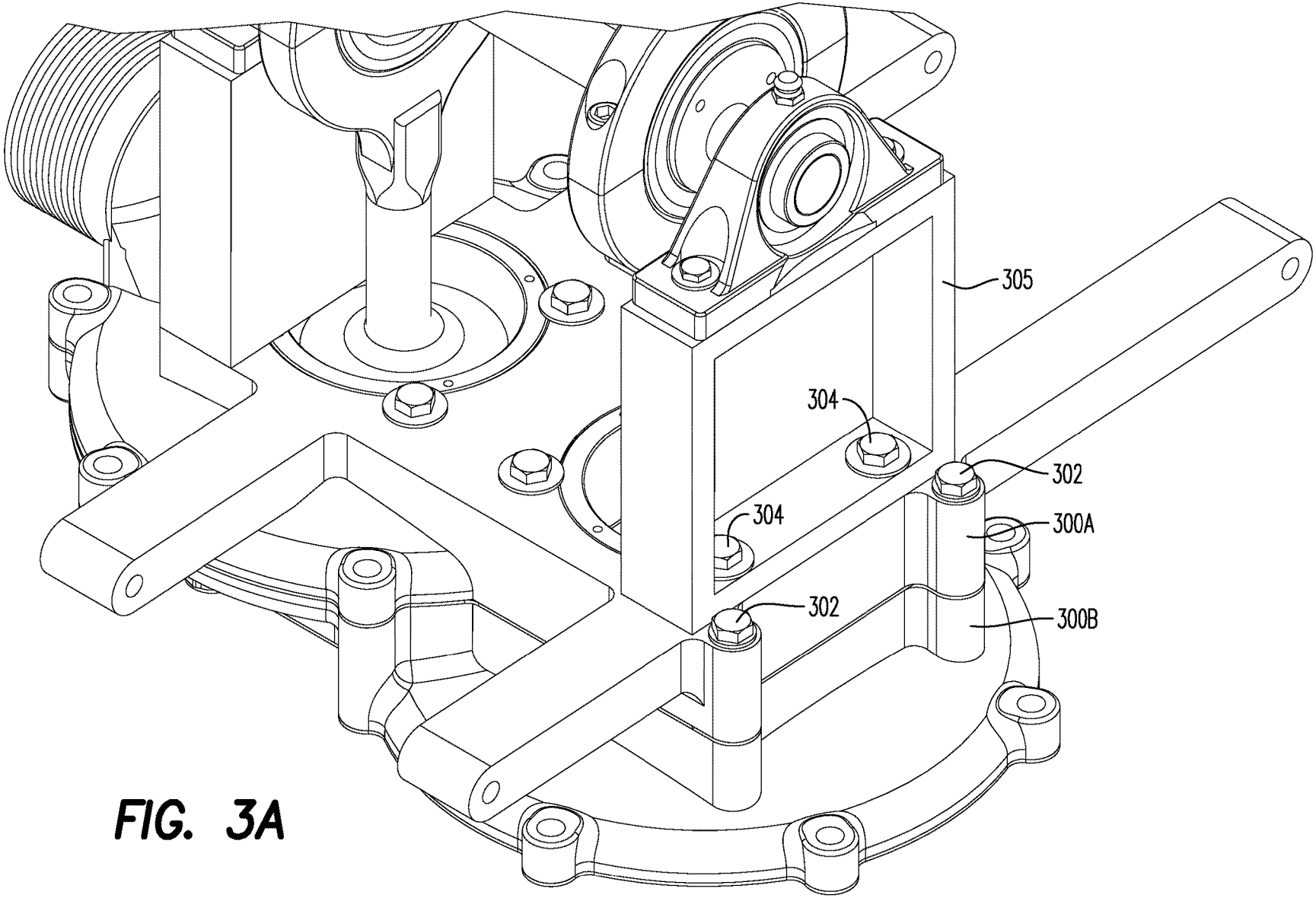
FIGS. 3A-3D are diagrams illustrating various states of a housing of the pump during disassembly in accordance with example embodiments.
Figure 3B:
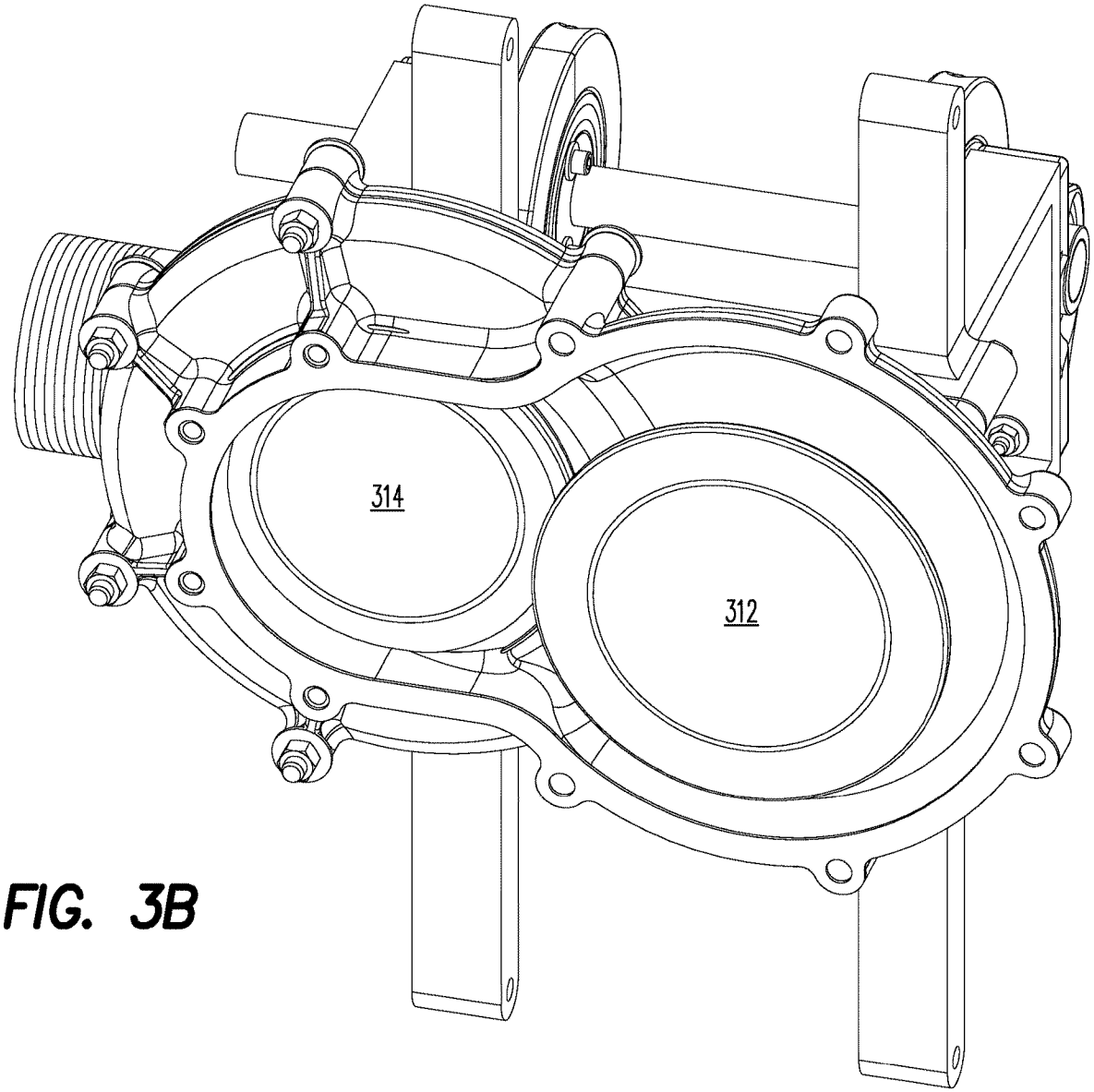

FIGS. 3A-3D further illustrate examples of the additional screws/bolts which are used to attach a top section 300A of the pump to an intermediate section 300B of the pump which is referred to as the intermediate housing section, a novel configuration that improves on the prior art pump housings. As shown in FIG. 3A, pedestal screws 304 are used to secure the pedestal 305 to the top section 300A. Meanwhile, extra screws 302 are used to secure the top section 300A to the intermediate section 300B thereby decoupling the securing of the pedestal 305 from the securing of the top section 300A and the bottom section 300B. Accordingly, the pedestal 305 can be removed/repaired independently without having to disassemble the top section 300A from the bottom section 300B. FIG. 3B shows an underneath view of the intermediate housing section 300B which exposes the two disc pads 314 and 312 of the disc pump. The disc pads 314 and 312 may be secured to the rods 204 and 205 shown in FIG. 2A by screwing them in, etc. Although not shown in this example, another rubber disc may be disposed above each disc pad 314 and 312 to provide an air tight seal within the intermediate housing section 300B. Accordingly, the intermediate housing provides for improved maintenance operator access while preserving integrity of the pump housing.

Figure 3C:
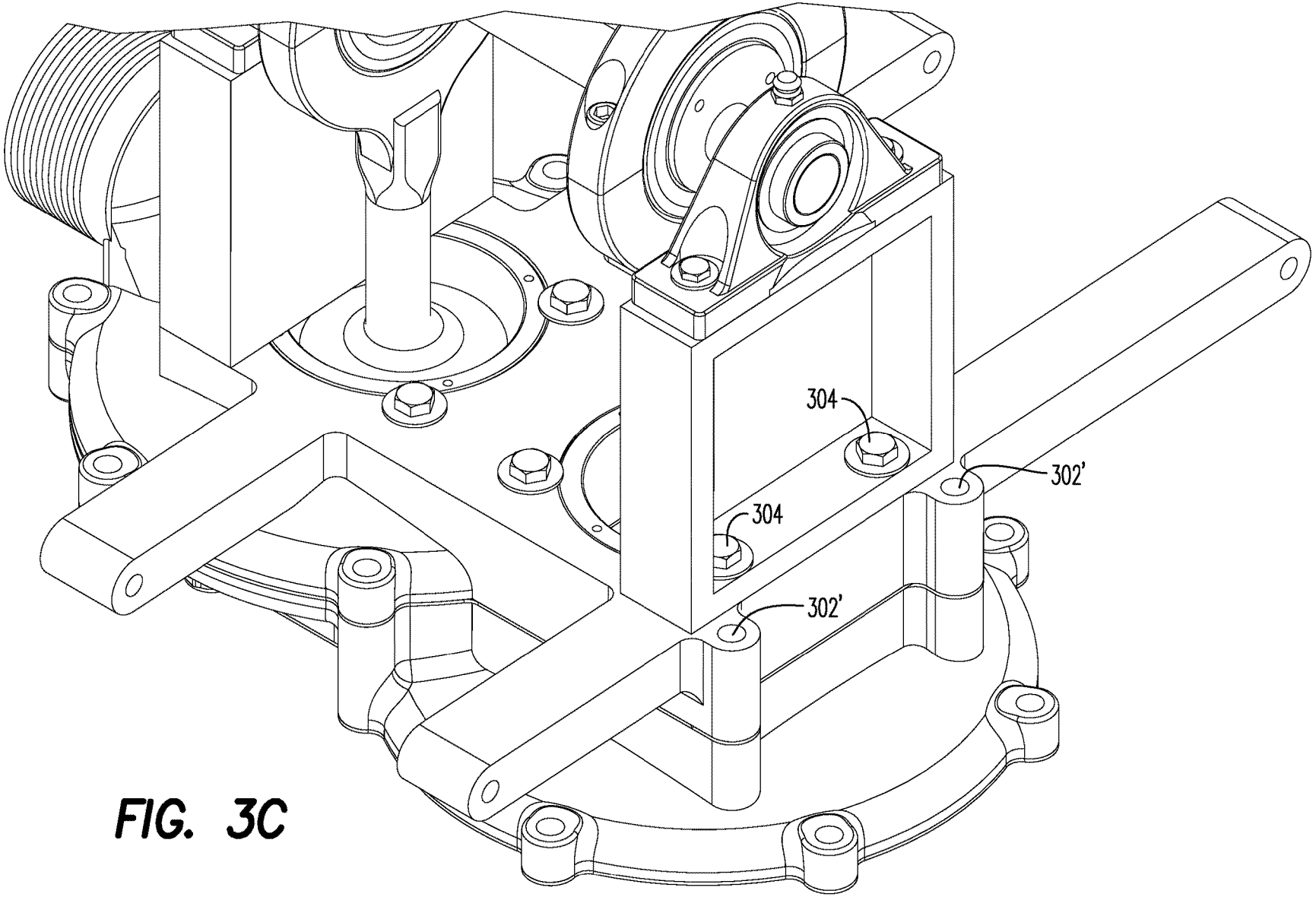
Figure 3D:
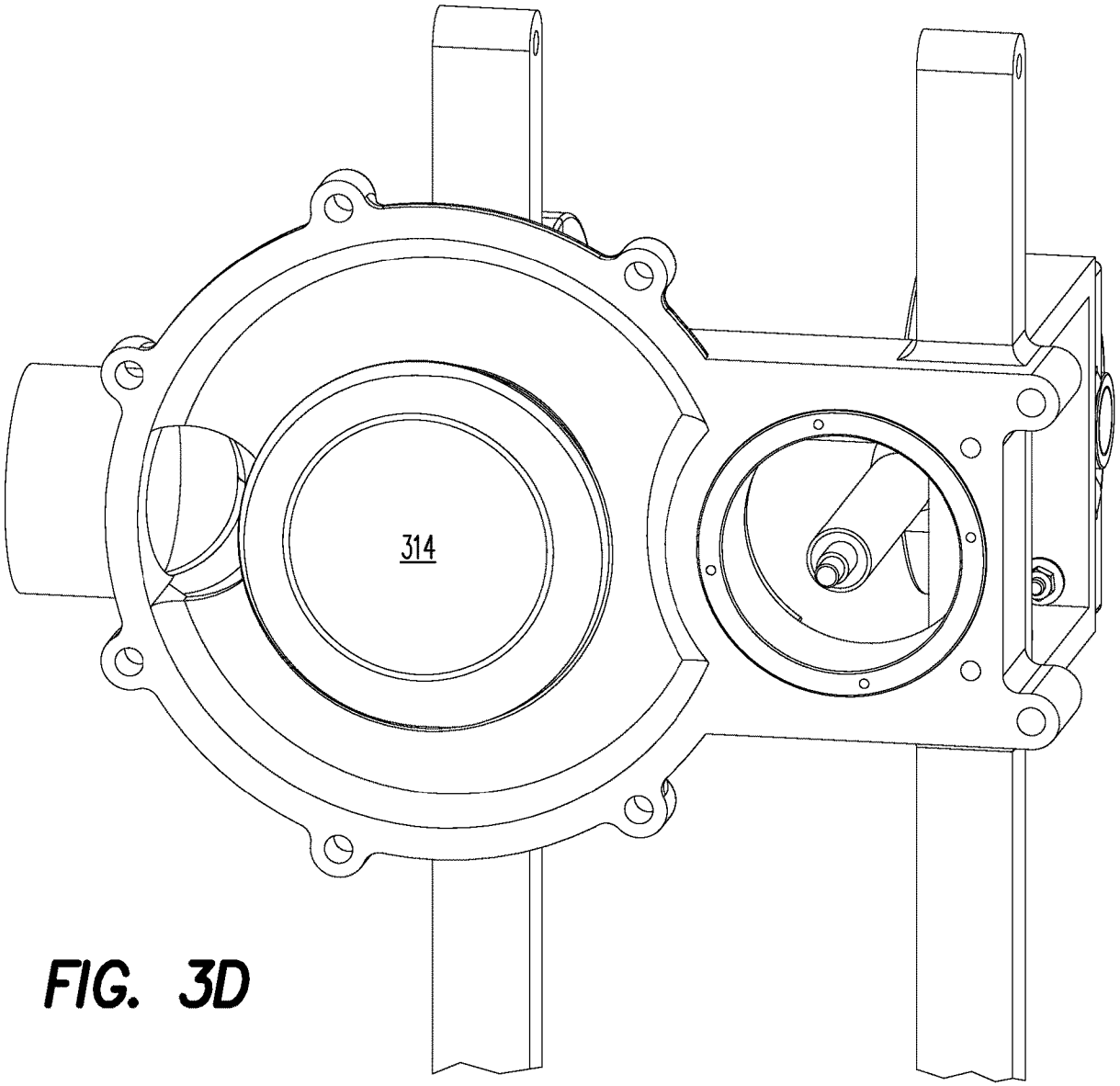

FIG. 3C shows the screws removed thereby leaving empty securing means 302'. As a result, the intermediate housing section 300B can be removed from the top section 300A to perform additional maintenance and repair of the disc pads 314 and 312 as shown in FIG. 3D. The two housing access bolts/screws 302 shown in FIG. 3A are used to secure the top section 300A to the intermediate housing section 300B independently from how the pedestal is secured to the top section. In the traditional design, the two bolts that hold down the pedestal bearing also connect to the intermediate housing section. By adding housing access screws 302, the top section 300A is connected to the intermediate housing section 300B independently of the pedestals.

The four discs are rubber and wear out over time as they are exposed to harsh chemicals, sludge, etc. To repair/replace the disc pads an operator needs to remove the bottom portion. Step two is that you have to remove the bottom segment of the pump which requires an operator to put their hands underneath the pump where the sludge has been contacting the pumps, to remove the bottom section of the pump assembly.

Figure 4A:
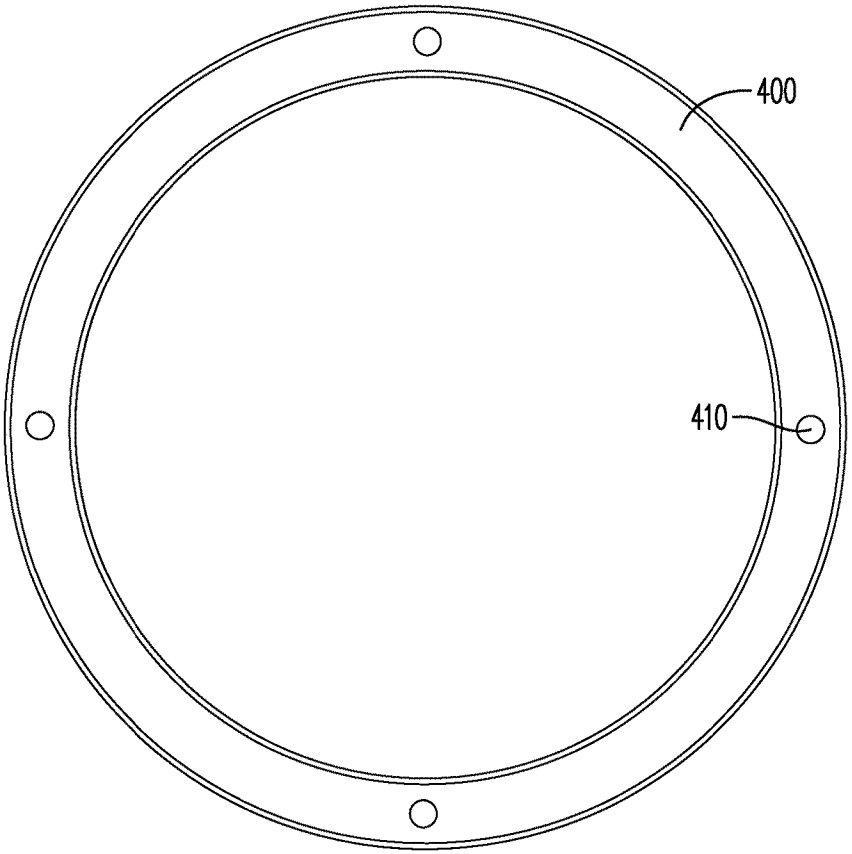
FIGS. 4A-4B are diagrams illustrating a metal ring that sits in the housing in accordance with example embodiments.
Figure 4B:
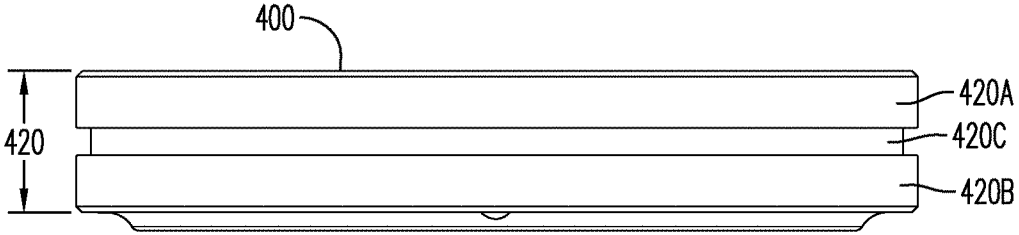

Referring to FIGS. 2A, 4A and 4B, a rubber sealing disc is retained by a metal ring 400 in one or more of the top section and the intermediate housing of the pump assembly. According to certain embodiments, metal ring 400 is an aluminum ring in a cast iron housing. There is galvanic corrosion that occurs over time and the metal ring 400 can weld itself to the housing. During disassembly, the ring may get stuck to the housing from the welding/corrosion. Therefore, the metal ring 400 may be designed with multiple jack screw holes 410 that allows a user to drive a screw in to ring 400 to force it out if it gets stuck. In addition, the metal ring 400 also has another novel feature which includes a recess 420C disposed within a side 420 of the metal ring which also includes two exterior portions 420A and 420B with the recess 420C disposed between. The recess 420C holds a sealing ring to provide a backup seal should the rubber sealing disc fail. The sealing ring also serves to reduce contact between the metal ring 400 and pump body thereby reducing the amount of galvanic corrosion that can occur.

Figure 5A:
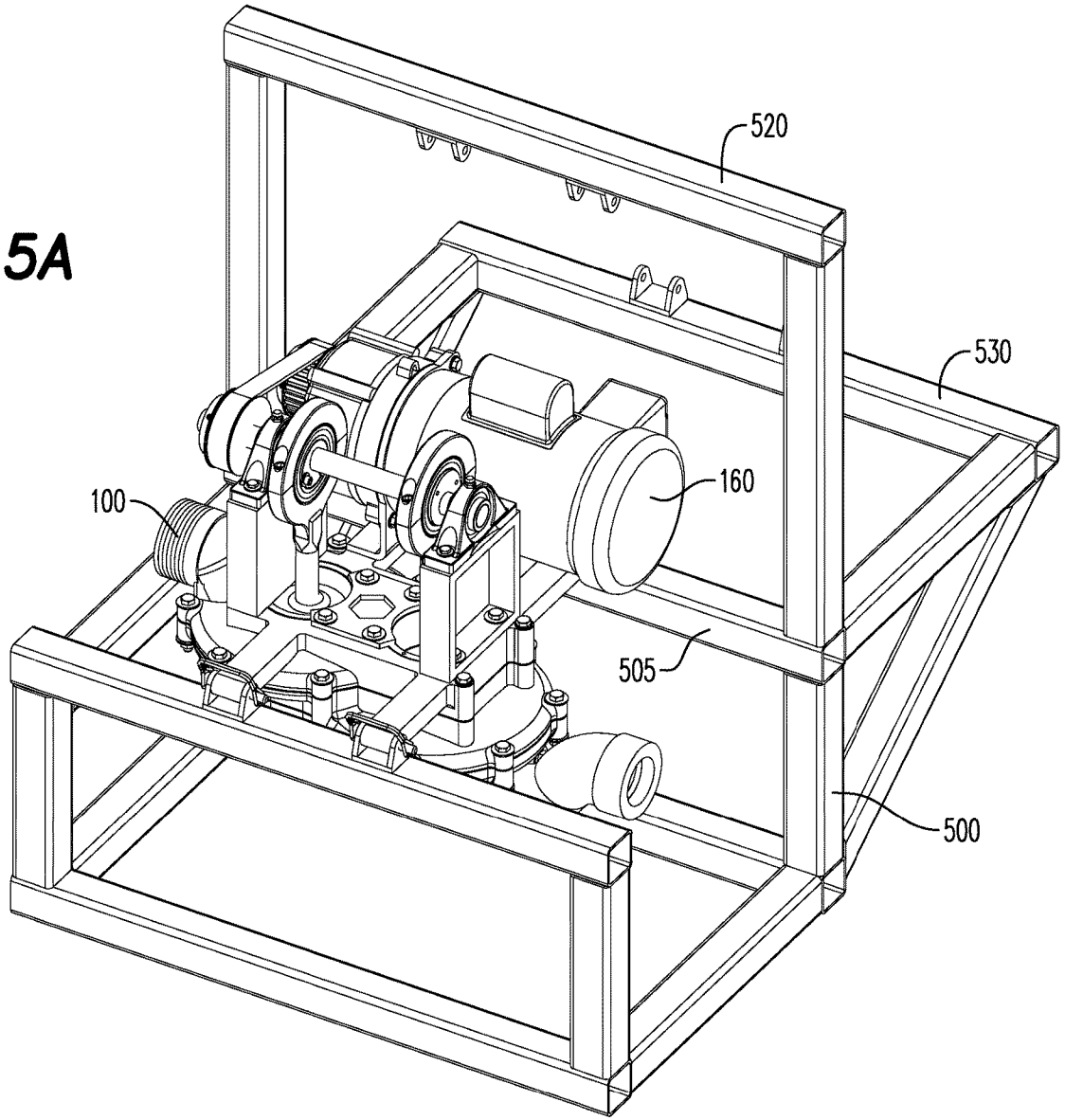
FIGS. 5A-5D are diagrams illustrating a pump system including a frame having different locking positions in accordance with an example embodiment.
Figure 5B:
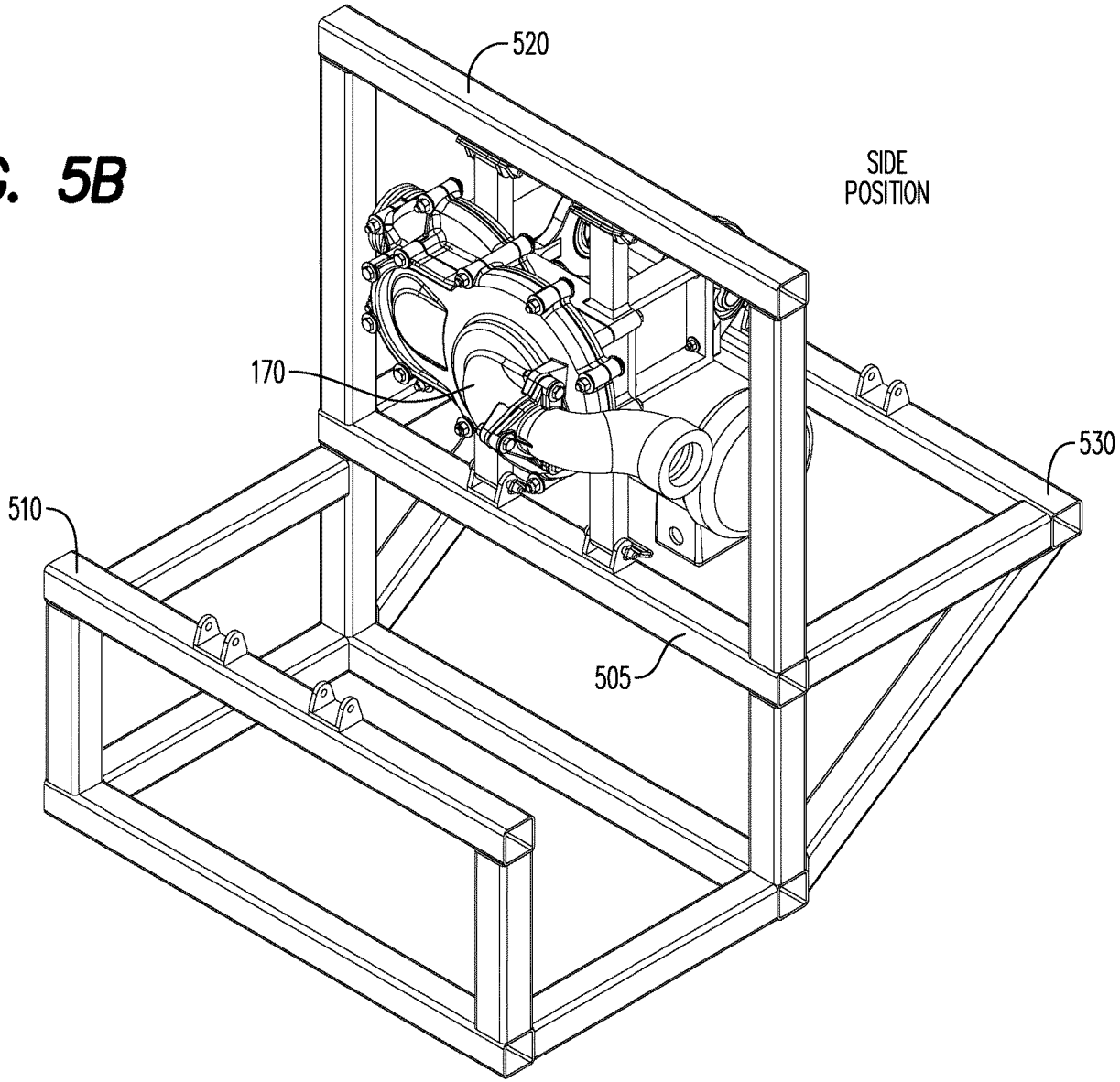
Figure 5C:
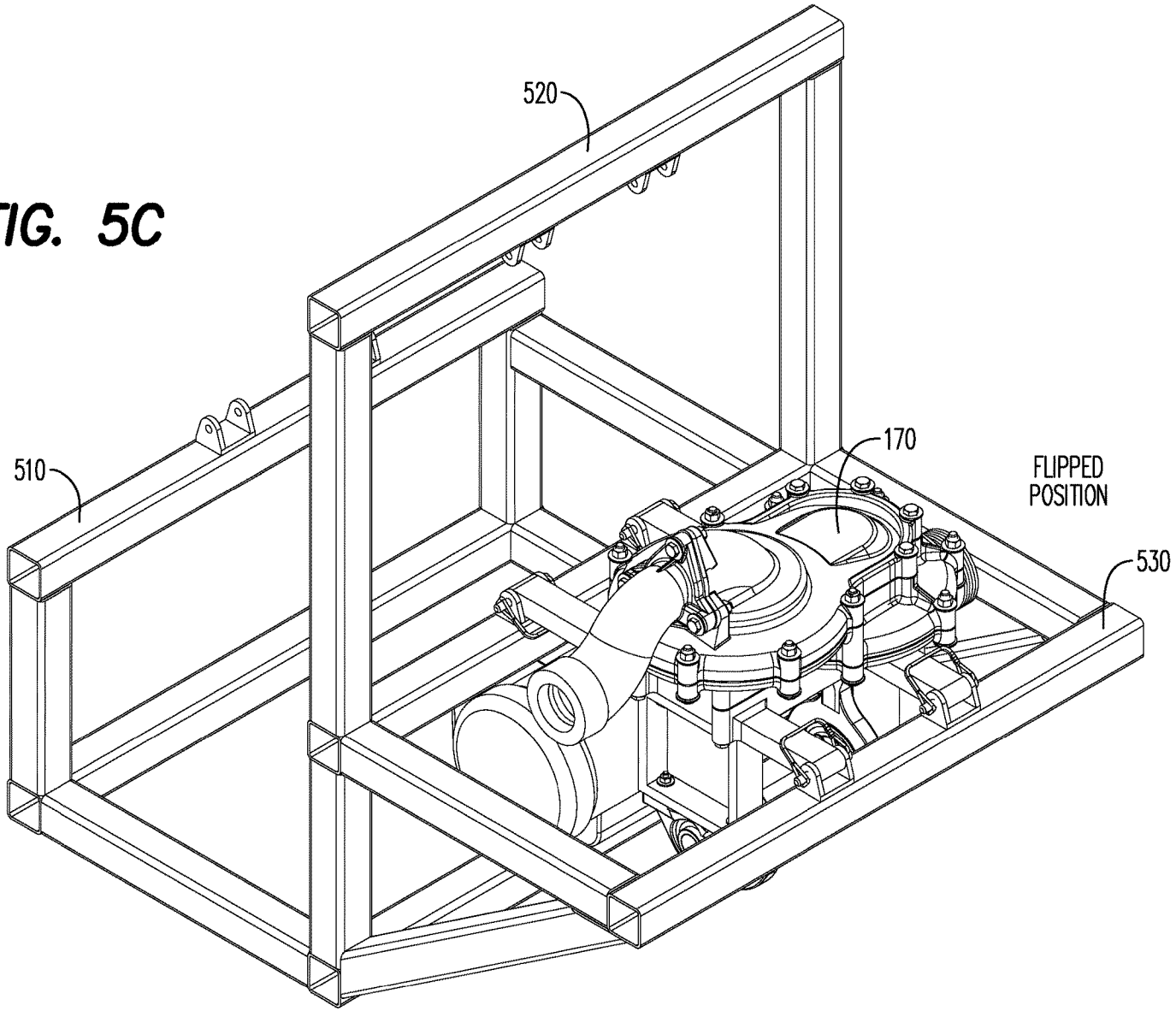
Figure 5D:
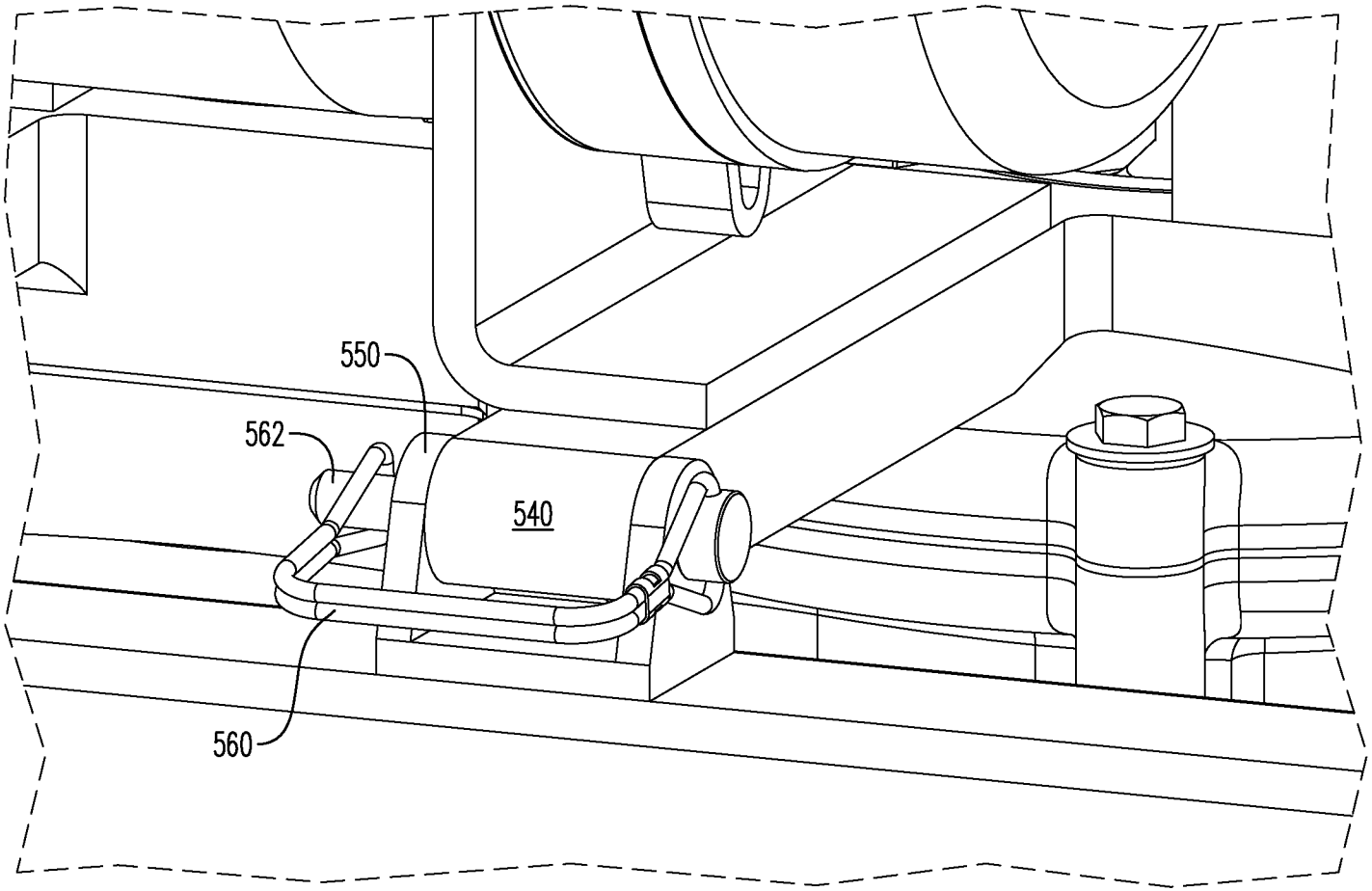

FIGS. 5A-5D illustrate a pump system including a frame 500 having different locking positions 510, 520, and 530 for securing an H-shaped member of a pump 100, in accordance with an example embodiment. Referring again to FIG. 2A, the top section of the pump includes an H-shaped support 200 which may have multiple arms that extend outwards from the intermediate housing of the pump. Disposed at an end of each arm may be a securing mechanism such as shown in FIG. 5D. The securing mechanism may include a clip, clasp, clamp, mounting ear, etc. In the example of FIG. 5D, an attachment portion 540 disposed on an arm end of the H-shaped member of the pump mates with a receiving portion 550 of the frame. Also, a locking pin 562 is inserted into a hole of the attachment portion 540 and the receiving portion 550 and held by a wire retainer 562 to couple the H-shaped member of the pump to the frame.

In order to maintain the pump in a traditional pump design, an operator has to go in from underneath (fix it in place) which means dropping the bottom segment out while it is full of sewage and positioned above the operator. As the other option, the operator may remove the whole pump and carry it over somewhere to work on it. Here, the pump (when full) including a full chamber 160 can weigh 150 lbs, etc. making this a difficult task especially for one user.

To overcome these problems, the example embodiments include securing mechanisms such as shown in FIG. 5D, along different arms of the H-shaped support which has arms extending from both sides of the pump assembly. Two arms extending from a first side of the H-shaped support may be secured to an internal post 505 of the frame 500. Meanwhile, two arms extending from a second side of the H-shaped support may be secured to different locking positions 510 (FIG. 5A), 520 (FIG. 5B), and 530 (FIG. 5C) enabling the pump 100 to be, e.g., disconnected from the inlet and outlet hoses, flipped over and held at different angles of rotation. In the example of FIG. 5A, the H-shaped member is held in the run position 510 which may be the normal operating position of the pump. In FIG. 5B, the pump has been rotated 90° and is held in the side position 520. In FIG. 5C, the pump has been flipped over and is held in the flipped position 530. Each time the user desires to move the pump, they may detach the securing mechanism (shown in FIG. 5D) on one side of the pump while leaving the securing mechanisms on the other side of the pump secured to the internal post 505, and swing the pump over. As another example, a hydraulic lift or other actuation means can be used to automatically power the pump to flip over.

The securing mechanism (which may be referred to as mounting ears) allow pivot/rotation of the assembly as a whole. The frame includes multiple sections that can catch and hold the mounting ears at different angles. Here, the frame includes a top mounting section which holds the mounting ears of the pump such that the bottom/underneath of the pump is facing out towards the side, and a mounting section on the right that allows the pump bottom to be completely flipped over and facing upward. This allows a user to work on the pump and its components from underneath without having to place herself or himself underneath the pump where gravity can cause sludge or other unwanted waste to drip on the user. The mounting ears are hinges with pins that allow the hinge to be clipped in and out by hand, serving as an attachment mechanism that permits the user to pick up and swing the pump. As another option, a hydraulic swing/lift could be placed on the pump creating an automated actuation means for driving/flipping the pump over.

According to various embodiments, a system may include the twin disc pump secured to different locking positions of a frame. The twin disc pump may include an H-shaped support element therein with securing mechanisms disposed on each side of the H-shaped support element. The frame may include an interior member that is configured to attach to a first side of the H-shaped support element via a securing mechanism which allows the twin disc pump to swing freely around the interior member, and a plurality of different locking positions configured to attach to a second side of the H-shaped support element to temporarily lock the twin disc pump at different orientations.

In some embodiments, the securing mechanism disposed on the second side of the H-shaped support element is configured to secure to the interior member of the frame while also allowing the H-shaped support element to pivotally rotate about the interior member of the frame. In some embodiments, the frame may include a first locking position which, when secured to the second side of the H-shaped support element, holds the twin disc pump in its normal operating position such that a bottom of the twin disc pump is facing downward. In some embodiments, the frame may include a second locking position which, when secured to the second side of the H-shaped support element, holds the twin disc pump on its side such that a bottom of the twin disc pump is facing sideways.

The frame may include a third locking position which, when secured to the second side of the H-shaped support element, holds the twin disc pump in a substantially inverted position such that a bottom of the twin disc pump is facing upwards. Accordingly, the frame may include a plurality of outer receiving members with respect to the interior member, and the plurality of outer receiving members are configured to orient the twin disc pump at different angles when secured to the second side of the H-shaped support element.

In some embodiments, the frame may be attached to or otherwise electrically connected to a hydraulic lift that drives the H-shaped member of the twin disc pump to rotate about the interior member of the frame while the first side of the H-shaped support element is secured to the interior member of the frame. For example, the hydraulic lift may be attached to an outer portion of the H-shaped support member closest to the edges of the H-shaped support member.

Figure 6:
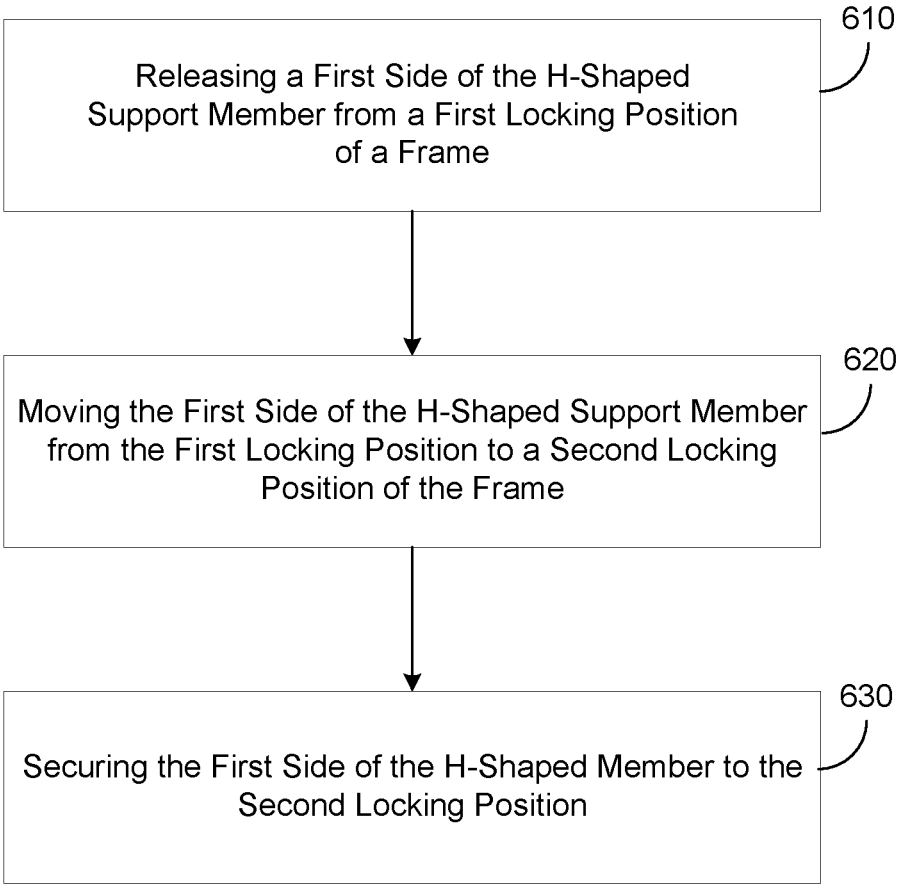
FIG. 6 is a diagram illustrating a method of operating a twin disc pump with a support frame in accordance with an example embodiment.

FIG. 6 illustrates a method of operating a twin disc pump within a support frame. Referring to FIG. 6, the method may be implemented on a system including a twin disc pump that is supported by an H-shaped support member and a frame that attaches to the H-shaped support member. In 610, the method may include releasing a first side of the H-shaped support member from a first locking position of the frame while a second side of the H-shaped member remains secured to an interior member of the frame. In 620, the method may include moving the first side of the H-shaped support member from the first locking position of the frame towards a second locking position of the frame, while the second side of the H-shaped support member remains secured to the interior member of the frame. In 630, the method may include securing the first side of the H-shaped support member to the second locking position of the frame.

In some embodiments, the first locking position holds the twin disc pump such that a bottom of the twin disc pump is oriented downward, and the second locking position holds the twin disc pump such that the bottom of the twin disc pump is oriented sideways or upwards. In some embodiments, the pushing may be performed via a hydraulic lift that drives the H-shaped support member holding the twin disc pump to rotate about the interior member of the frame while the first side of the H-shaped support member remains attached to the interior member of the frame.

The above descriptions and illustrations of processes herein should not be considered to imply a fixed order for performing the process steps. Rather, the process steps may be performed in any order that is practicable, including simultaneous performance of at least some steps. Although the disclosure has been described regarding specific examples, it should be understood that various changes, substitutions, and alterations apparent to those skilled in the art can be made to the disclosed embodiments without departing from the spirit and scope of the disclosure as set forth in the appended claims.

The invention claimed is:

1. A pump comprising:

an intermediate pump housing comprising inlet plumbing receiving fluid and discharge plumbing discharging the fluid;

dual pump discs disposed within the intermediate pump housing, each pump disc attached to a bearing disposed above the intermediate pump housing;

two pedestals connected to an upper portion of the intermediate housing and disposed on opposing sides of the dual pump discs, each pedestal comprising a pedestal bearing that is independent of the pump disc bearings;

an upper support element disposed above the intermediate housing and supporting the two pedestals, wherein the upper support element comprises an H-shaped portion having attachment mechanisms at an end of each arm of the H-shaped portion for securing the pump to a frame for the pump; and a drive shaft which is received by the pump disc bearings and the pedestal bearings, wherein, when rotated, the drive shaft causes the dual pump discs to reciprocally move up and down within the intermediate pump, wherein a top of each of the pump disc bearings is detachable via a securing mechanism such that the drive shaft can be detached from the dual pump discs by an operator from above the intermediate pump housing without disassembly of the intermediate pump housing.

2. The pump of claim 1, wherein the pump disc bearings are split cylindrical bearings.

3. The pump of claim 1, wherein the pedestal bearings comprise pillow block bearings.

4. The pump of claim 1, wherein the upper support element is secured to the intermediate pump housing via additional securing mechanisms disposed independently of the two pedestals.

5. The pump of claim 1, wherein the upper support element comprises two metal rings configured to receive the dual pump discs.

6. The pump of claim 5, wherein each metal ring comprises an intermediate recess to hold a sealing ring to provide backup sealing should a rubber sealing disc fail.

7. The pump of claim 5, wherein each metal ring comprises screw holes configured to receive screws for pushing the metal ring out of the metal ring's position within the upper support element.

8. A pump system comprising:

a twin disc pump comprising an H-shaped support element therein with securing mechanisms disposed on each side of the H-shaped support element; and a frame comprising an interior member that is configured to attach to a first side of the H-shaped support element via a securing mechanism which allows the twin disc pump to swing freely around the interior member, and a plurality of different locking positions configured to attach to a second side of the H-shaped support element to temporarily lock the twin disc pump at different orientations.

9. The pump system of claim 8, wherein the securing mechanism disposed on the first side of the H-shaped support element is configured to secure to the interior member of the frame while also allowing the H-shaped support element to pivotally rotate about the interior member of the frame.

10. The pump system of claim 8, wherein the frame comprises a first locking position which, when secured to the second side of the H-shaped support element, holds the twin disc pump in its normal operating position such that a bottom of the twin disc pump is facing downward.

11. The pump system of claim 8, wherein the frame comprises a side locking position which, when secured to the second side of the H-shaped support element, holds the twin disc pump on its side such that a bottom of the twin disc pump is facing sideways.

12. The pump system of claim 8, wherein the frame comprises a flipped locking position which, when secured to the second side of the H-shaped support element, holds the twin disc pump in a substantially inverted position such that a bottom of the twin disc pump is facing upwards.

13. The pump system of claim 8, further comprising a hydraulic lift that drives the twin disc pump to rotate about the interior member of the frame while the first side of the H-shaped support element is secured to the interior member of the frame.

14. The pump system of claim 8, wherein the frame comprises a plurality of outer receiving members with respect to the interior member, and the plurality of outer receiving members are configured to orient the twin disc pump at different angles when secured to the second side of the H-shaped support element.

15. A dual disc pump comprising:

a housing which holds dual pump discs, each pump disc attached to a split rod bearing disposed above the housing, and a top of each of the split rod bearings is detachable via a securing mechanism;

an upper support element connected to the housing;

two pedestals connected to an upper portion of the housing and disposed on opposing sides of the dual pump discs, wherein each pedestal comprises a pedestal bearing that is independent of the split rod bearings, and the upper support element comprises an H-shaped portion having attachment mechanisms at an end of each arm of the H-shaped portion for securing the pump to a frame for the pump; and an unbalanced drive shaft which is received by the split rod bearings and the pedestal bearings, wherein, when rotated, the unbalanced drive shaft causes the dual pump discs to reciprocally move up and down within the housing.

* * * * *